US008122644B2

(12) United States Patent
Jarolim

(10) Patent No.: US 8,122,644 B2
(45) Date of Patent: Feb. 28, 2012

(54) PIVOTABLE SLIDING DOOR

(75) Inventor: Reinhold Jarolim, Weyer (AT)

(73) Assignee: Knorr-Bremse Gesellschaft mit beschrankter Haftung, Modling (AT)

( * ) Notice: Subject to any disclaimer, the term of this patent is extended or adjusted under 35 U.S.C. 154(b) by 551 days.

(21) Appl. No.: 11/816,506

(22) PCT Filed: Feb. 9, 2006

(86) PCT No.: PCT/EP2006/001134

§ 371 (c)(1),
(2), (4) Date: Jul. 17, 2008

(87) PCT Pub. No.: WO2006/087132

PCT Pub. Date: Aug. 24, 2006

(65) Prior Publication Data

US 2009/0007491 A1 Jan. 8, 2009

(30) Foreign Application Priority Data

Feb. 17, 2005 (AT) ..... A 264/2005

(51) Int. Cl.
*E05D 15/10* (2006.01)

(52) U.S. Cl. ..... 49/209; 49/216; 49/221; 49/223; 49/258

(58) Field of Classification Search ..... 49/209, 49/210, 211, 216, 218, 219, 220, 221, 223, 49/254, 258, 259; 296/155, 146.11, 146.12; 16/366, 368, 369, 370, 371, 357, 361, 343, 16/344, 346

See application file for complete search history.

(56) References Cited

U.S. PATENT DOCUMENTS

| | | | | | |
|---|---|---|---|---|---|
| 1,832,174 | A * | 11/1931 | Zahner et al. | 49/254 |
| 3,318,048 | A * | 5/1967 | Odend'Hal | 49/223 |
| 3,383,798 | A * | 5/1968 | Day | 49/219 |
| 3,640,565 | A * | 2/1972 | Anderson | 296/100.04 |
| 3,683,552 | A * | 8/1972 | Bollinger, Sr. | 49/209 |
| 3,750,335 | A * | 8/1973 | Marsh | 49/220 |
| 5,896,704 | A * | 4/1999 | Neag et al. | 49/209 |
| 6,386,621 | B1 * | 5/2002 | Kozak et al. | 296/155 |
| 6,681,448 | B2 * | 1/2004 | Liang | 16/336 |
| 6,926,342 | B2 * | 8/2005 | Pommeret et al. | 296/155 |
| 7,426,803 | B2 * | 9/2008 | Fronz et al. | 49/209 |
| 2005/0235564 | A1 * | 10/2005 | Fronz et al. | 49/209 |
| 2006/0225356 | A1 * | 10/2006 | Jarolim | 49/209 |

FOREIGN PATENT DOCUMENTS

| | | | |
|---|---|---|---|
| DE | 2657285 | A | 7/1977 |
| EP | 0259568 | A2 | 3/1988 |
| EP | 0936119 | A | 8/1999 |

* cited by examiner

*Primary Examiner* — Jerry Redman
*Assistant Examiner* — Catherine A Kelly
(74) *Attorney, Agent, or Firm* — Barnes & Thornburg LLP

(57) ABSTRACT

A pivotable, sliding door is provided that includes a door leaf and a first roller lever disposed adjacent to a lateral closing edge of the door leaf. The first roller lever defines first and second ends. A guide rail is disposed on the door leaf. A roller is disposed on the first end of the first roller lever and in the guide rail. A locking element is disposed on the second end of the first roller lever. A retaining element, affixable to a door frame, is disposed adjacent to the second end of the first roller lever, the retaining element defining a stop and a predetermined, curved track. The first roller lever is displaceable along the predetermined, curved track to the stop. In the stop position, the first roller lever is pivotable into a locked position where the locking element engages the retaining element.

9 Claims, 4 Drawing Sheets

PIVOTABLE SLIDING DOOR

CROSS-REFERENCE TO RELATED APPLICATIONS

This application is a National Stage Patent Application based upon and claiming priority to International Patent Application No. PCT/EP2006/001134, filed on Feb. 9, 2006. In turn, the International Application relies for priority on Austrian Patent Application No. A 264/2005, filed on Feb. 17, 2005. This National Stage Application relies for priority upon these applications, both of which are incorporated herein by reference.

FIELD OF THE INVENTION

The invention relates to pivotable sliding doors for all types of vehicles. More specifically, the invention relates to doors for rail vehicles with a roller lever which is arranged in the region of the lateral closing edge and engages by means of its roller in a guide rail arranged on the door leaf.

DESCRIPTION OF THE RELATED ART

The pivot lever systems currently used on the lower edge of a door for guiding the door have the task of guiding the lower side of the door wing along a predetermined track such that it does not collide with the doorway. In the open state, the door is held in a defined position at a distance from the outer contour of the vehicle.

However, these pivot lever systems suffer from at least one disadvantage. Specifically, although they carry out a guiding function, they do not have any locking function. Moreover, forces that act transversely to the plane of the door leaf have to be essentially absorbed by the door leaf itself. With such an arrangement, the door leaf may become distorted, causing the door seals to lift off from the sealing plane and to form an opening gap on the lateral closing edge. A gap of this type causes a draft in the interior of the vehicle, causes external noise to enter the vehicle, and causes the door leaf to vibrate, all of which potentially disturb the passengers. In addition, when the door leaf vibrates, the mounting of the door leaf may wear out. Also, when the door leaf vibrates, it may impact with the doorway edges.

EP 0 936 119 B1 discloses a pivotable sliding door of one type known in the prior art.

DE 26 57 285 A1 discloses a door control device which has, on a pivot spindle 9, a swinging side arm 8. The swinging side arm 8 may be pivoted with respect to the rail car body. The swinging side arm 8 engages in a supporting guide, which is connected to the door leaf in the form of a slot 17. The guide, together with the door leaf, may be pushed into the open position corresponding to the pivoted-out position of the swinging side arm 8. The sole movement that the swinging side arm is able to execute is a rotation about a vertical axis fixed on the rail car body.

A curve is connected to the swinging side arm such that it can rotate about an axis that protrudes rearward (into the interior of the rail car). One of the ends of the curve is guided in a curved guide (slot) and is coupled directly to the door opening mechanism. In the curved guide, the end of the curve assumes a fixed position at the end of the door closing operation. To be released from this fixed position when the door is opened, the curve first must be released via a complicated connecting mechanism to the door drive. That connecting mechanism may includes a hoop, connecting rod, and a further hoop and reaction arm.

EP 0 259 568 A describes a pivotable sliding door for vehicles. In the case of this pivotable sliding door, the pivot lever for the door leaf is only rotatable about a vertical axis. In principle, it is therefore identical to each of the two preceding publications.

SUMMARY OF THE INVENTION

It is the aim of the invention, by means of a suitable design of a pivot lever system, to absorb transverse forces acting on the door leaf in the region of the lateral closing edge of the door leaf. The invention introduces a pivot lever system into the doorway. A locking action is derived from the closing force provided by the door drive, i.e., without further supply of external power.

According to the invention, this aim is achieved with a pivotable, sliding door of the type known in the art. The pivotable, sliding door includes a roller lever that may be displaced along a predetermined, preferably curved track to a position defined by a stop. In the stop position, the pivotable, sliding door may be pivoted into a locked position. In the locked position, a locking element associated with the roller lever engages in a retaining element fixed on the doorway.

In this case, part of the longitudinal movement of the door leaf at the end of the closing operation assists to retain or lock the door transversely with respect to the plane of the door leaf. The locking of the door leaf is made possible via a suitable lever or guide system. The locked position corresponds, more or less, to a dead center position or beyond a dead center position, which prevents the door from being pushed open from the inside.

In addition to the locking of the roller lever, the invention employs a very shallow deployment curve at the beginning of the deployment movement and a steep deployment curve only in a later phase of the deployment movement. Therefore, when pivoting the door inwardly, the path is separated into two functionally different subregions, the first being a pure guiding function (steep deployment curve), the second a guiding and locking function (shallow deployment curve).

The essence of the invention is that, at the beginning of the final closing movement of the door, the roller lever is first displaced along a predetermined track as far as a predetermined stop position. Although the stop point prevents further displacement of the roller lever, it permits pivoting thereof, which is subsequently forced on the roller lever by the door closing movement. The roller lever itself does not have its own drive and all of its movements originate from the movement of the door leaf which, in turn, is moved by the door drive in the direction along the plane of the door leaf.

After pivoting, i.e., in the closed position of the door, the roller lever is in a locked position or dead center position with respect to a force acting perpendicularly on the door leaf from the interior of the vehicle. Locking of the door is made possible via a retaining element, for example, a roller lever journal, which engages behind an edge. When the door is pivoted inwardly, the roller lever roller, which engages in the guide rail first follows the steep part of the deployment path. When further pivoting of the door is restricted by the stop, the roller lever roller follows the shallow part of the deployment path, which leads into the closed position of the door. At the same time as the shallow part of the deployment path is being covered, locking of the roller lever takes place.

Of course, it is conceivable that the shallow part of the deployment path may run parallel to the plane of the door leaf. However, in this contemplated embodiment, there is the risk of a collision between the door edge and the doorway upright or frame.

As discussed in connection with the invention, if the shallow part of the deployment path does not run completely parallel to the plane of the door leaf, the above-described problem of the door leaf being opened from the interior of the vehicle is efficiently eliminated. In this case, the locking of the door leaf when the door is closed, i.e., its closing force, prevents the door leaf from being displaced in a direction parallel to the plane of the door leaf. In other words, the closing force interacts with the lever system according to the invention.

Such locking means are generally implemented in the door drive itself and are designed, for example, in the form of a spindle-type locking mechanism for the door leaf supporting arm, which is fastened to a spindle nut. Components of the transverse force, which would cause pivoting of the roller lever out of its retaining element and, therefore, cause deployment of the door leaf are intercepted by the locking of the door leaf. Components of the transverse force perpendicular thereto are absorbed by the retaining element fixed on the doorway. The shallower the deployment path, the smaller the force component which has to be absorbed by the locking of the door leaf. As a result, when the door is closed, the invention provides a pivotable sliding door that effectively prevents the formation of an air gap.

In one contemplated refinement, the pivotable sliding door includes a predetermined track that is defined by a lever. The lever is connected to the roller lever in an articulated manner about an axis. The lever also is connected to the rail car body in an articulated manner about an axis. A displaceable guide is also provided. The guide is fixed on the doorway. A guide element, for example, a journal, a roller or the like, arranged on the lever arm of the roller lever remotely from the door leaf, may be displaced along the guide. This arrangement enables a curved or circular displacement of the roller lever to be implemented in a very elegant manner.

In one variant, the predetermined track of the pivotable, sliding door is defined by a guide, which is fixed on the rail car body. The roller lever may be displaced, by means of guide elements, for example journals, rollers or the like, in the guide. The shape of the guide defines the initial movement of the pivotable, sliding door, and the number of movable parts is reduced by this measure.

BRIEF DESCRIPTION OF THE DRAWINGS

The invention is explained in more detail below with reference to the drawing, in which.

DESCRIPTION OF EMBODIMENT(S) OF THE INVENTION

Figure 1:
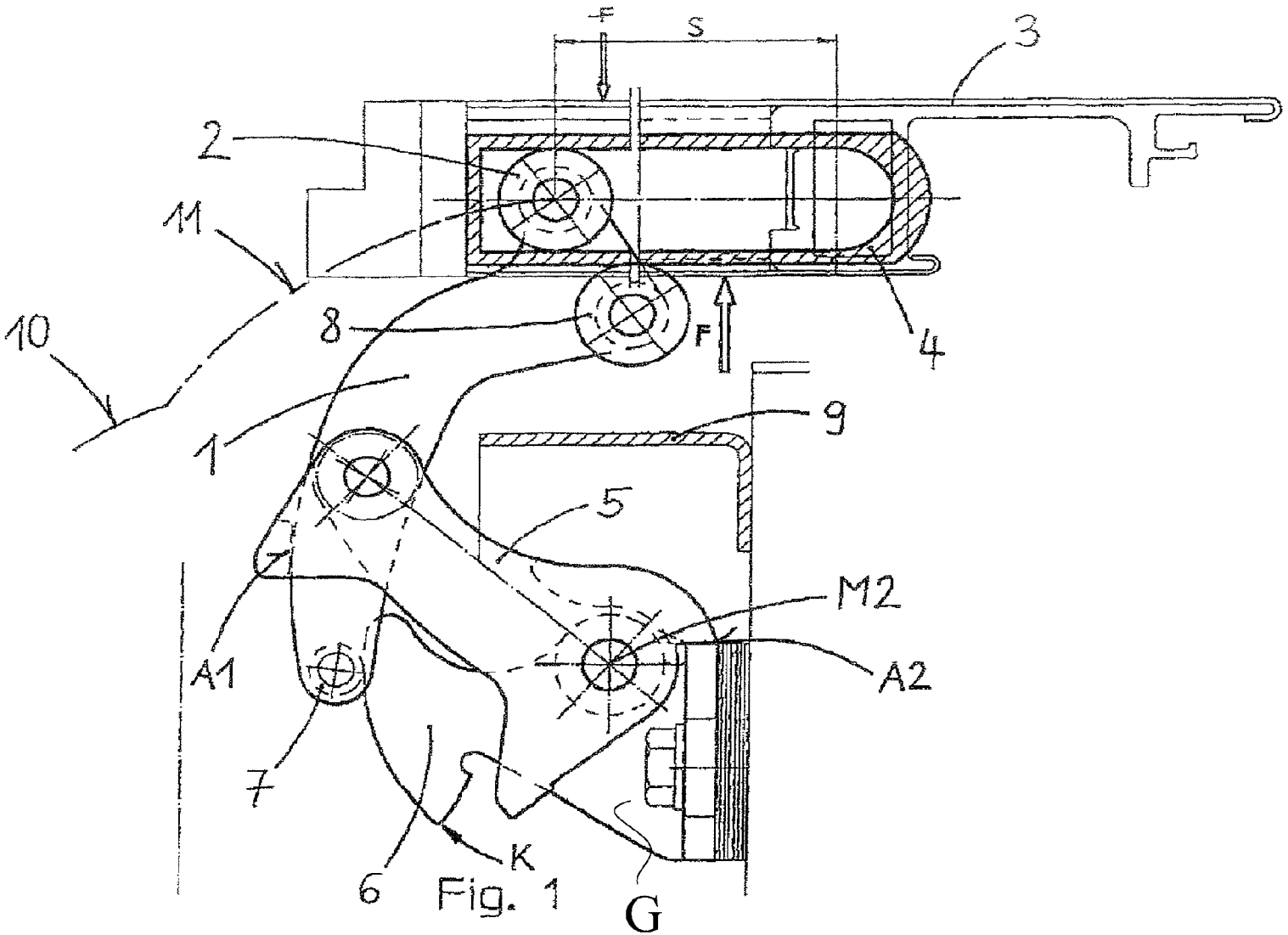
FIG. 1 shows the pivotable sliding door according to the invention in a completely open state.

The pivotable, sliding door according to the invention, illustrated in FIG. 1, comprises a door leaf 3 with a guide rail 4. A roller lever 1 engages the guide rail 4 via a roller 2. A roller 8, which is also mounted on the roller lever 1, bears against the outside of the guide rail 4. Together with the roller 2, the roller 8 embraces part of the wall of the guide rail 4. The roller lever 1 is mounted on a pivot lever 5 such that the roller lever 1 may rotate about a vertical axis M1. The pivot lever 5 is, in turn, mounted adjacent to the lateral closing edge such that the pivot lever 5 may be rotated about a vertical axis M2 with respect to the doorway. The pivoting of the two levers 1 and 5 in relation to each other is restricted by a stop A1 on the lever 5. A roller 7, which is guided along a slotted guide mechanism G fixed on the doorway, is mounted rotatably on an end of the roller lever 1 facing away from the door leaf 3. The end of the curved slotted guide mechanism G is marked by a bend K. The bend K is a retaining element of the roller lever 1. The roller 7 engages the bend K when the door is closed.

The closing process will be explained in more detail below.

FIG. 1 shows the pivotable sliding door in a completely open state. The door leaf 3 is guided and is displaceable freely along the path S in the guide rail 4.

Figure 2:
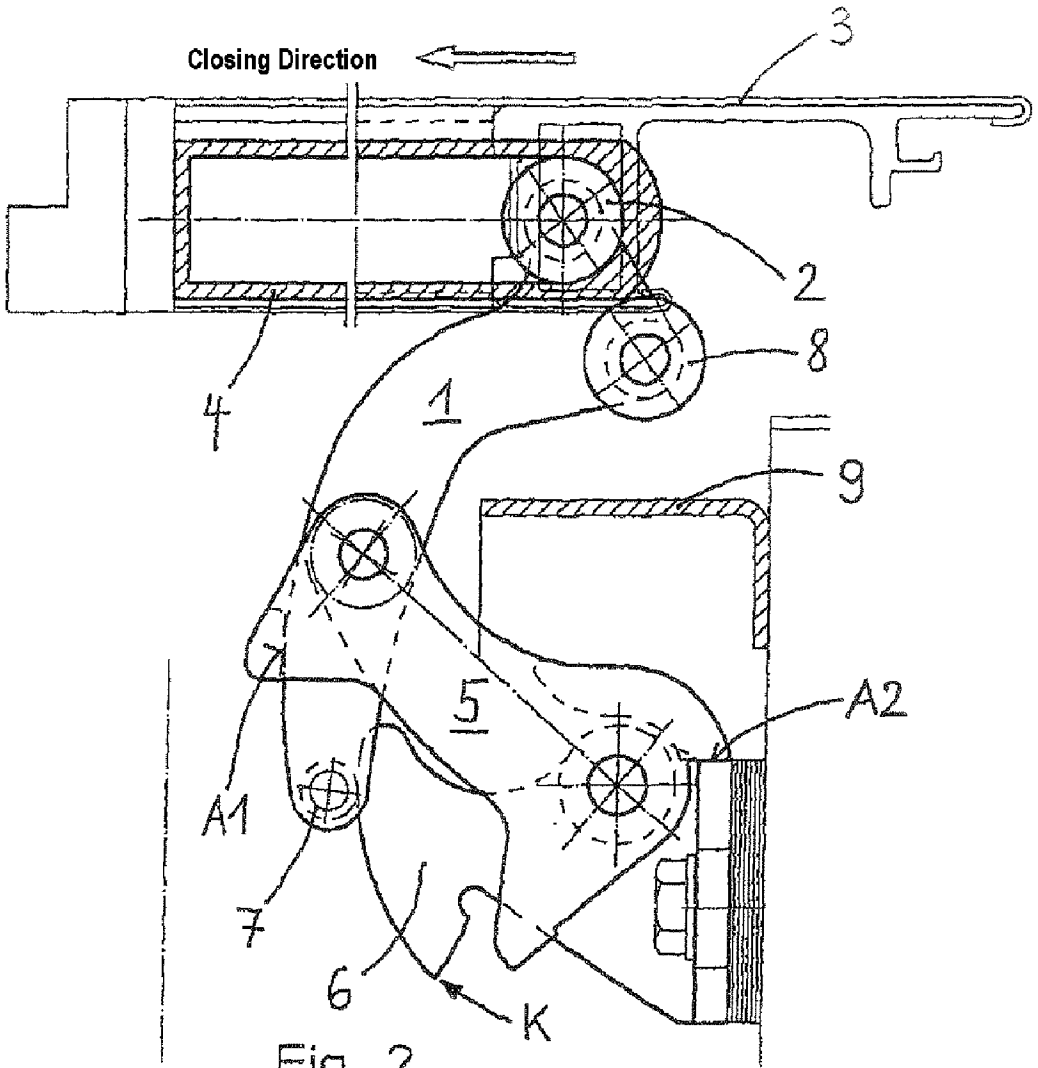
FIG. 2 shows the pivotable sliding door of FIG. 1 before the beginning of the final closing movement of the door.

FIG. 2 shows the position of the door leaf after the displacement thereof along the path S, but not in the fully pivoted-out position. As the closing operation continues, the roller 2, which is fastened to the roller lever 1, is moved along by the end of the guide rail 4. The roller lever 1 is connected to the pivot lever 5 in an articulated manner about the vertical axis M1. The pivot lever 5, in turn, is connected to a bracket 6, which is fixed on the doorway. The pivot lever 5 is fixed on the bracket 6 in an articulated manner about the vertical axis M2. A supporting roller 7, which is fitted on the roller lever 1, bears against a part of the bracket 6, which is shaped in the form of a slotted guide. The slotted guide portion of the bracket 6, therefore, prevents a rotation of the roller lever 1 about the vertical axis M1 and causes rotation both of the roller lever 1 and of the lever 5 about the vertical axis M2. This pure rotational movement continues until the bending point K of the slotted guide is reached.

Figure 3:
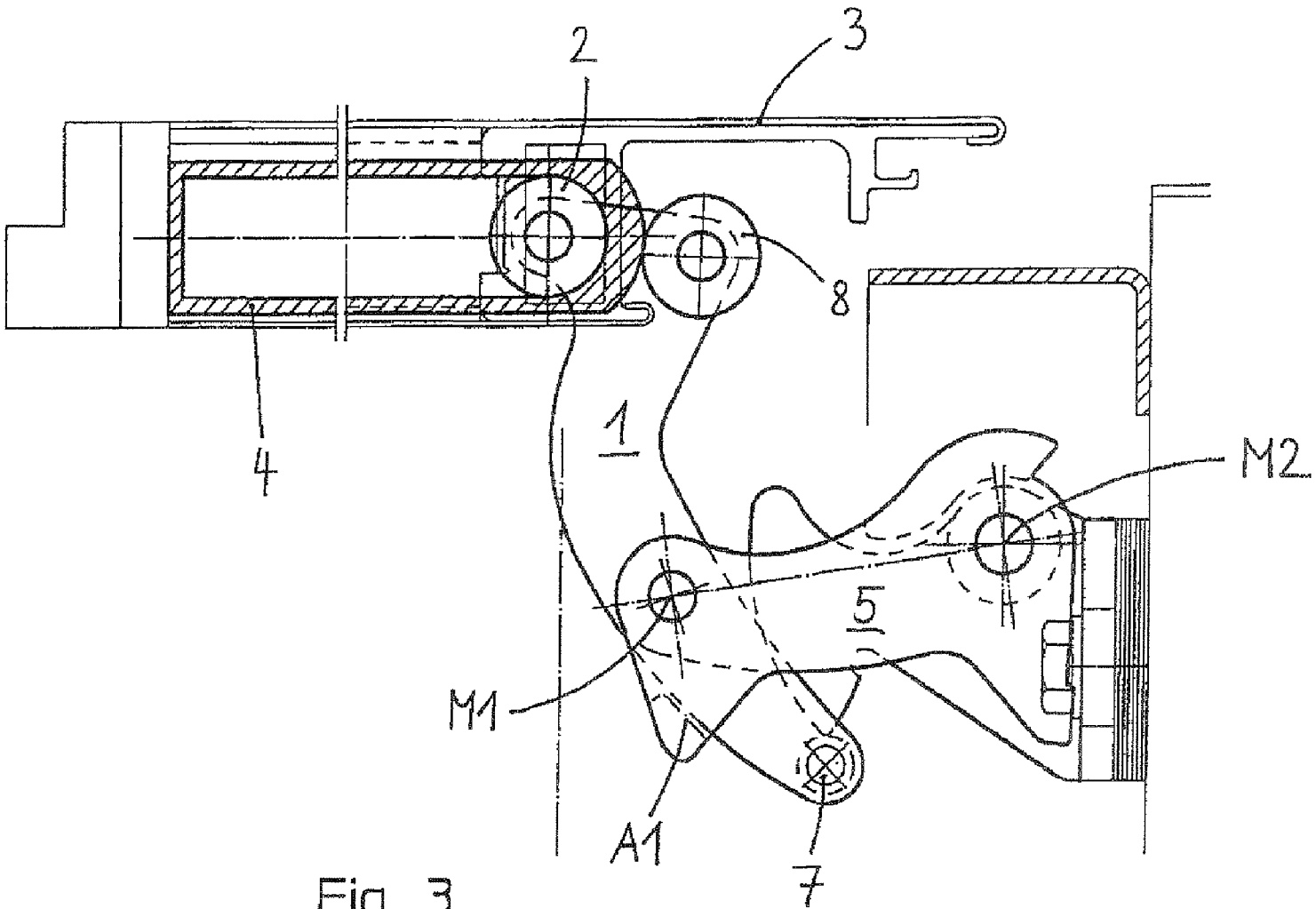
FIG. 3 shows the pivotable sliding door of FIG. 1 shortly before the beginning of the locking operation.

FIG. 3 shows the beginning of the locking operation. In this case, the supporting roller 7, which is fastened to the roller lever 1, is guided about the vertical axis M1 over the bending point K of the slotted guide. The roller 7 is then brought into a locked position. In the locked position, the lever system is prevented from rotating back in the direction of the opening movement by means of a force acting perpendicularly on the door leaf from the interior of the vehicle as indicated by an arrow F in FIG. 4. As a result, at the and of the door travel, the door wing is locked at the rear edge by the supporting roller 7 bearing against the bending contour of the bracket 6 fixed on the doorway. With the end of the rotational movement of the pivot lever 5, the pivoting of the roller lever 1 therefore begins.

Figure 4:
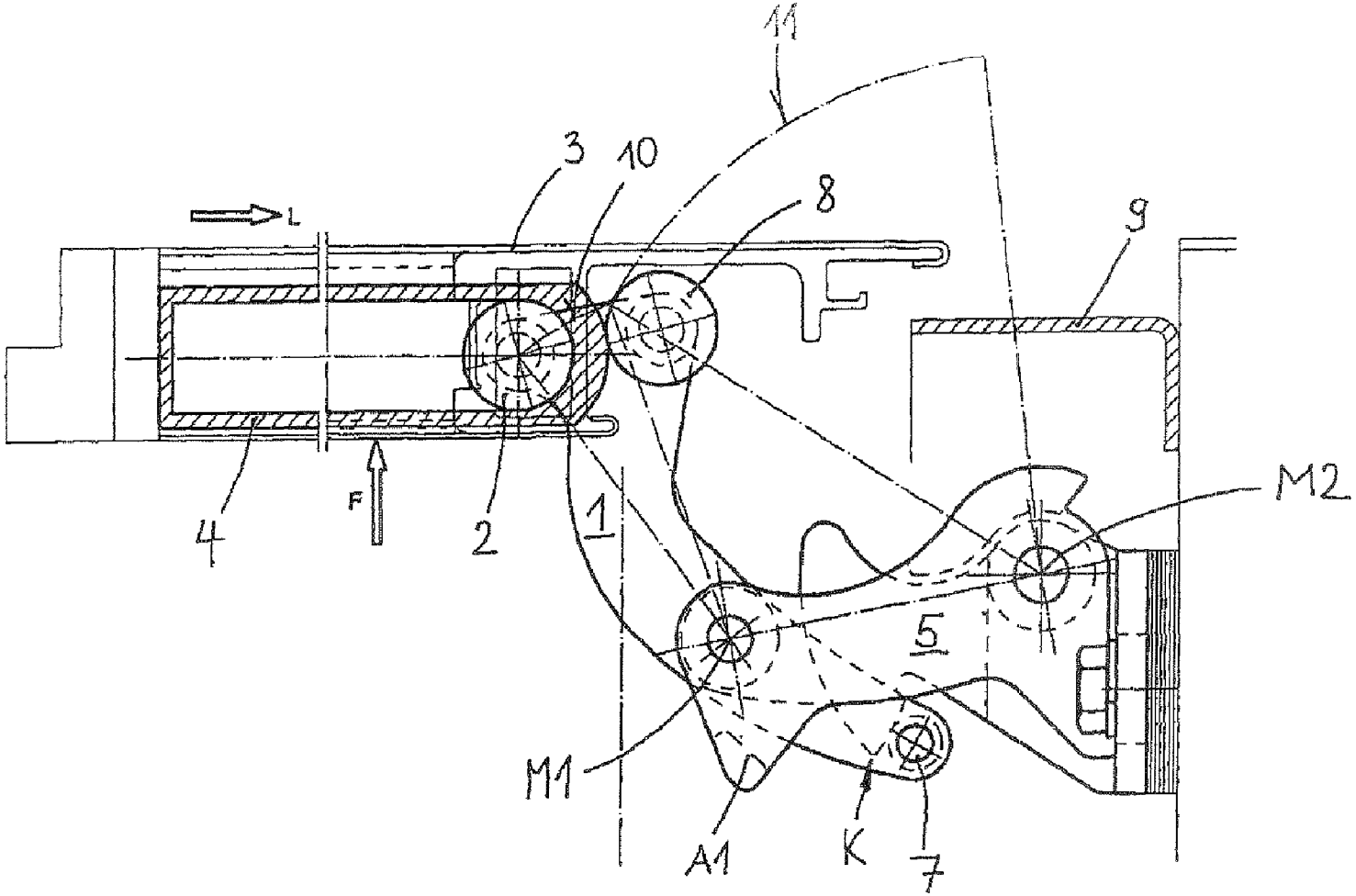
FIG. 4 shows the completely closed and locked pivotable, sliding door according to the invention.

During the door opening operation, as illustrated in FIG. 4, the door leaf 3 and therefore the guide rail 4 are moved in the direction of the arrow L. With assistance from the roller 8 fastened to the roller lever 1, the roller lever 1 is rotated about the vertical axis M1, and the supporting roller 7 is moved out of the locking position. This rotational movement is restricted by the stop A1 fitted to the pivot lever 5. Accordingly, as the opening movement of the door leaf 3 continues, the roller lever 1 and the lever 5 rotate about the vertical axis M2 until a further stop A2 is reached. The stop A2 is fitted to the pivot lever 5 and restricts further rotational movement. Once the stop A2 is reached, the rollers 2 and 8 take up such a position relative to the guide rail 4 that the guide rail 4 is displaced longitudinally between the rollers 2 and 8. As a result, the door 3 is brought again into the fully pivoted-out position, as illustrated in FIG. 1. The roller 8 which, when the door is closed, bears against the outside of the end side of the guide rail 4 serves to pivot the roller lever 1 during the driving of the door leaf.

In addition, the arrangement of the rollers 2 and 8 on the roller lever 1 is such that, up to the beginning of the locking operation, a force in the direction of the arrow F on the door wing 3 does not permit any rotation of the lever system about M2. Forces in the direction of the arrow F are also reliably absorbed by the lever arrangement at the stop A2. As a result, the door leaf is held in a stable manner even in the open state of the door. For this purpose, the roller 8 bearing against the outside of the guide rail is offset laterally with respect to the roller 2 engaging in the guide rail in the direction of the lateral closing edge. Therefore, the roller 8 serves as a support for the door leaf.

As is apparent from the figures, the pivoting of the roller lever 1 out of the retaining element brings about a shallow deployment movement, the beginning of which runs virtually parallel to the plane of the door leaf. In contrast thereto, the subsequent pivoting of the lever 5 causes a substantially steeper deployment movement. The profiles of the shallow part 10 and of the steep part 11 of the deployment path apparent in both FIG. 1 and FIG. 4. The component of the force F that acts transversely with respect to the plane of the door leaf and causes a pivoting of the roller lever 1 is intercepted directly by the locking of the door leaf on account of the shallowness of the deployment curve. The component of force perpendicular to the force F is directed into the doorway via the roller lever retaining element that is fixed on the doorway. The lever system itself does not have its own drive and can only be pivoted by the movement of the door leaf.

With a view to avoiding collision of the door leaf 3 with the sealing angle 9, the steep extension curve makes it possible at the same time to realize small longitudinal dimensions of the device.

In the exemplary embodiment illustrated, the predetermined track along which the roller lever can may be displaced during the door closing and opening movement is defined by an additional pivot lever 5 in conjunction with a slotted guide mechanism. The joint M1 moves on a circular track, and the roller 7 on a circular or curved contour of a guide fixed on the doorway. However, it is conceivable to arrange the roller lever 1 in a guide, for example a curved, preferably circular slotted guide mechanism or a guide rail, in a manner such that it can be displaced, for example via two journals, rollers, etc. that engage in the guide. A stop position serves to restrict the displacement of the roller lever during the door closing operation but at the same time permits a pivoting of the roller lever. This may be realized, for example, by one of the two guide journals bearing against the stop while the other journal, which is preferably arranged at the end of the roller lever, may deviate out of the guide rail in the direction of the doorway wall via a recess in the guide rail. Furthermore, by pivoting of the roller lever, similar to the manner illustrated in FIG. 3, the roller lever may take up a locked position or a dead center position behind an edge.

The invention is not restricted to the exemplary embodiments illustrated. Thus, during the pivoting of the roller lever, instead of the roller 7, a locking element provided specifically for this purpose can engage in the retaining element, for example a journal, a web or the like, fixed on the rail car body. Other embodiments and variations that may be apparent to those skilled in the art are intended to be encompassed by the invention.

The invention claimed is:

1. A pivotable, sliding door, comprising:

a door leaf;

a first roller lever disposed adjacent to a lateral closing edge of the door leaf, the first roller lever defining first and second ends;

a guide rail disposed on the door leaf;

a first roller disposed on the first end of the first roller lever and in the guide rail;

a locking element disposed on the second end of the first roller lever; and a retaining element, affixable to a door frame, disposed adjacent to the second end of the first roller lever, the retaining element defining a stop and a predetermined, curved track, wherein the first roller lever is displaceable along the predetermined, curved track to the stop, and wherein, in the stop position, the first roller lever is pivotable into a locked position where the locking element engages the retaining element, wherein, when the first roller lever is in the locked position, the locking element locks the door leaf in position, and wherein the locking element moves in two directions relative to the retaining element to engage the retaining element and lock the door leaf in position, which two directions being different than a direction of movement of the door leaf.

2. The pivotable, sliding door of claim 1, further comprising:

a second roller lever pivotably connected to the first roller lever, thereby defining a first axis; and a guide, affixable to the door frame, defining the retaining element, wherein the second roller lever is connected pivotally to the guide, thereby defining a second axis, and wherein the locking element comprises a guide element that engages the guide.

3. The pivotable, sliding door of claim 2, wherein the retaining element defines a bend therein.

4. The pivotable, sliding door claim 2, wherein the guide element is also the locking element.

5. The pivotable, sliding door of claim 1, wherein the predetermined, curved track is defined by a guide, which is affixable to the door frame.

6. The pivotable, sliding door of claim 1, wherein the first roller lever comprises the first and a second roller that engage a wall of the guide rail.

7. The pivotable, sliding door of claim 2, wherein the guide element is at least one of a journal or a roller.

8. The pivotable, sliding door of claim 3, wherein the retaining element defines a recess therein.

9. The pivotable, sliding door of claim 6, wherein, in an open position of the door leaf, the first and second rollers are offset laterally from one another in a direction toward the lateral closing edge.

* * * * *